US009668632B2

(12) United States Patent
Suda

(10) Patent No.: US 9,668,632 B2
(45) Date of Patent: Jun. 6, 2017

(54) CLEANING TOOL

(71) Applicant: UNI-CHARM CORPORATION, Ehime (JP)

(72) Inventor: Tomokazu Suda, Kanonji (JP)

(73) Assignee: UNICHARM CORPORATION, Ehime (JP)

( * ) Notice: Subject to any disclaimer, the term of this patent is extended or adjusted under 35 U.S.C. 154(b) by 0 days.

(21) Appl. No.: 14/766,441

(22) PCT Filed: Jan. 10, 2014

(86) PCT No.: PCT/JP2014/050382

§ 371 (c)(1),
(2) Date: Aug. 6, 2015

(87) PCT Pub. No.: WO2014/122951

PCT Pub. Date: Aug. 14, 2014

(65) Prior Publication Data

US 2015/0374197 A1 Dec. 31, 2015

(30) Foreign Application Priority Data

Feb. 7, 2013 (JP) ..... 2013-022751

(51) Int. Cl.
*A47L 13/16* (2006.01)
*A47L 13/38* (2006.01)
(Continued)

(52) U.S. Cl.
CPC ..... *A47L 13/38* (2013.01); *A47L 13/14* (2013.01); *A47L 13/16* (2013.01); *A47L 13/44* (2013.01); *A47L 13/46* (2013.01)

(58) Field of Classification Search
CPC ..... A47L 13/16; A47L 13/38
See application file for complete search history.

(56) References Cited

U.S. PATENT DOCUMENTS 823,725 A 6/1906 Hayden
1,437,145 A 11/1922 Johnson
(Continued)

FOREIGN PATENT DOCUMENTS

CN 1775162 A 5/2006
EP 1967120 A2 9/2008
(Continued)

OTHER PUBLICATIONS

International Search Report mailed Mar. 25, 2014 in International Application No. PCT/JP2014/050382.
(Continued)

*Primary Examiner* — Randall Chin
(74) *Attorney, Agent, or Firm* — Hauptman Ham, LLP

(57) ABSTRACT

To provide a cleaning tool exhibiting excellent cleaning effectiveness. The present invention relates to a cleaning tool comprising a cleaning sheet, and a holding tool for holding said cleaning sheet. The cleaning sheet is provided with: a brush part configured so as to be capable of cleaning an object to be cleaned; a base part; and insertion parts through which holding parts of the holding tool are inserted. The brush part is configured so as to be provided with: a first cleaning region; a second cleaning region; and a bent region which is sandwiched therebetween, and which is formed by being bent by an end of the base part.

16 Claims, 19 Drawing Sheets

(51) Int. Cl.

| | |
|---|---|
| ***A47L 13/44*** | (2006.01) |
| ***A47L 13/46*** | (2006.01) |
| ***A47L 13/14*** | (2006.01) |

(56) References Cited

U.S. PATENT DOCUMENTS

| | | | | |
|---|---|---|---|---|
| 6,813,801 | B2 * | 11/2004 | Tanaka | A47L 13/20 15/209.1 |
| 8,359,699 | B2 * | 1/2013 | Tanaka | A47L 13/38 15/226 |
| 8,789,233 | B2 * | 7/2014 | Tsuchiya | A47L 13/16 15/226 |
| 2006/0101601 | A1 | 5/2006 | Fujiwara et al. | |
| 2008/0216264 | A1 | 9/2008 | Tanaka | |
| 2010/0154156 | A1 | 6/2010 | Takabayashi et al. | |
| 2012/0073075 | A1 | 3/2012 | Tanaka et al. | |

FOREIGN PATENT DOCUMENTS

| | | | |
|---|---|---|---|
| EP | 1992268 | A1 | 11/2008 |
| EP | 2415381 | A1 | 2/2012 |
| JP | 2005-152334 | A | 6/2005 |
| JP | 2007-29136 | A | 2/2007 |
| JP | 2008-29800 | A | 2/2008 |
| JP | 2011-161274 | A | 8/2011 |

OTHER PUBLICATIONS

Office Action in CN Application No. 201480007794.2, dated Jun. 1, 2016.

Written Opinion in International Application No. PCT/JP2014/050382, mailed Mar. 25, 2014.

Extended European Search Report mailed Sep. 20, 2016 in European Application No. 14749463.7.

Office Action in Japanese Patent Application No. 2013-022751, dated Dec. 9, 2016.

Office Action in CN Patent Application No. 201480007794.2, dated Feb. 4, 2017.

* cited by examiner

CLEANING TOOL

RELATED APPLICATIONS

The present application is a National Phase of International Application Number PCT/JP2014/050382, filed Jan. 10, 2014, and claims priority of Japanese Patent Application No. 2013-022751 filed on Feb. 7, 2013.

TECHNICAL FIELD

The present invention relates to a cleaning tool for cleaning an object to be cleaned.

BACKGROUND ART

Japanese Unexamined Patent Application Publication (JP-A) No. 2007-029136 discloses a cleaning article having a fiber layer and a scraping sheet. When used, the cleaning article is attached to a grip.

PRIOR ART DOCUMENT

Patent Document

Patent Document 1: JP-A No. 2007-029136

SUMMARY OF THE INVENTION

Problem to be Solved by the Invention

In the cleaning article disclosed in JP-A No. 2007-029136, the fiber layer and the scraping sheet have the same length in the width direction. An object to be cleaned by this kind of cleaning article may have a complicated shape. In such a case, a satisfactory cleaning work may not be performed with the cleaning article disclosed in JP-A No. 2007-029136. Specifically, in some cases, due to the existence of the scraping sheet, fibers forming the fiber layer cannot sufficiently deform according to the shape of the object to be cleaned.

Accordingly, it is an object of the present invention to provide a cleaning tool having an excellent cleaning effect.

Means for Solving the Problem

In order to solve the above problem, according to a preferred aspect of the present invention, a cleaning tool having a cleaning sheet and a holder for holding the cleaning sheet is provided. The cleaning sheet is configured to extend in a longitudinal direction which is defined by a direction of insertion of the holder into the cleaning sheet, and in a transverse direction which is defined by a direction crossing the longitudinal direction. The holder has a holding part for holding the cleaning sheet, and a grip part which is connected to the holding part and designed to be held by a user. The cleaning sheet has a brush part capable of cleaning an object to be cleaned, a base connected with the brush part, and an insertion part which is formed on the base and into which the holding part is inserted. The brush part is configured to have a first cleaning region, a second cleaning region and a bending region between the first and second cleaning regions by being bent at an end of the base.

In a further aspect of the cleaning tool according to the present invention, the brush part is configured to be longer than the base and has an extending region.

In a further aspect of the cleaning tool according to the present invention, the first cleaning region is formed in a region of the brush part which is overlapped on the base.

In a further aspect of the cleaning tool according to the present invention, the second cleaning region is formed in a region of the brush part which is not overlapped on the base.

In a further aspect of the cleaning tool according to the present invention, the second cleaning region is provided in the transverse direction.

In a further aspect of the cleaning tool according to the present invention, the second cleaning region is provided in the longitudinal direction.

In a further aspect of the cleaning tool according to the present invention, the second cleaning region is provided in the transverse direction and the longitudinal direction.

In a further aspect of the cleaning tool according to the present invention, the brush part is formed by a fiber assembly.

In a further aspect of the cleaning tool according to the present invention, the base is formed by a first sheet element.

In a further aspect of the cleaning tool according to the present invention, the cleaning tool has a second sheet element which is superposed on the first sheet element, and the insertion part is formed between the first sheet element and the second sheet element.

In a further aspect of the cleaning tool according to the present invention, the insertion part is formed by forming a bonding sheet region by contact of prescribed surfaces of the first sheet element with each other and bonding the prescribed surfaces in the bonding sheet region.

In a further aspect of the cleaning tool according to the present invention, the cleaning tool has a third sheet element which is superposed on the first sheet element, and a fourth sheet element which is superposed on the third sheet element, and the insertion part is formed between the third sheet element and the fourth sheet element.

In a further aspect of the cleaning tool according to the present invention, the cleaning tool has a fifth sheet element which is superposed on the first sheet element, and the insertion part is formed by forming a bonding sheet region by contact of prescribed surfaces of the fifth sheet element with each other and bonding the prescribed surfaces in the bonding sheet region.

In a further aspect of the cleaning tool according to the present invention, the brush part is provided on one side of the base.

In a further aspect of the cleaning tool according to the present invention, the brush part is provided on one side and the other side of the base.

Effect of the Invention

According to the present invention, a cleaning tool having an excellent cleaning effect can be realized by providing first and second cleaning regions.

BEST MODES FOR CARRYING OUT THE INVENTION (Outline of Cleaning Tool)

An embodiment of the present invention is now described with reference to FIGS. 1 to 8. A structure of a cleaning tool A as one embodiment of a "cleaning tool" according to the present invention is now explained. Objects to be cleaned by using the cleaning tool A typically include surfaces to be cleaned (floors, walls, windows, ceilings, external walls, furniture, clothes, curtains, bedding, lighting, home electric appliances, etc.) inside and outside of houses, apartments, buildings, factories, vehicles, etc. and surfaces of human body parts to be cleaned. The surfaces to be cleaned may be either flat or curved, uneven or stepped.

Figure 1:
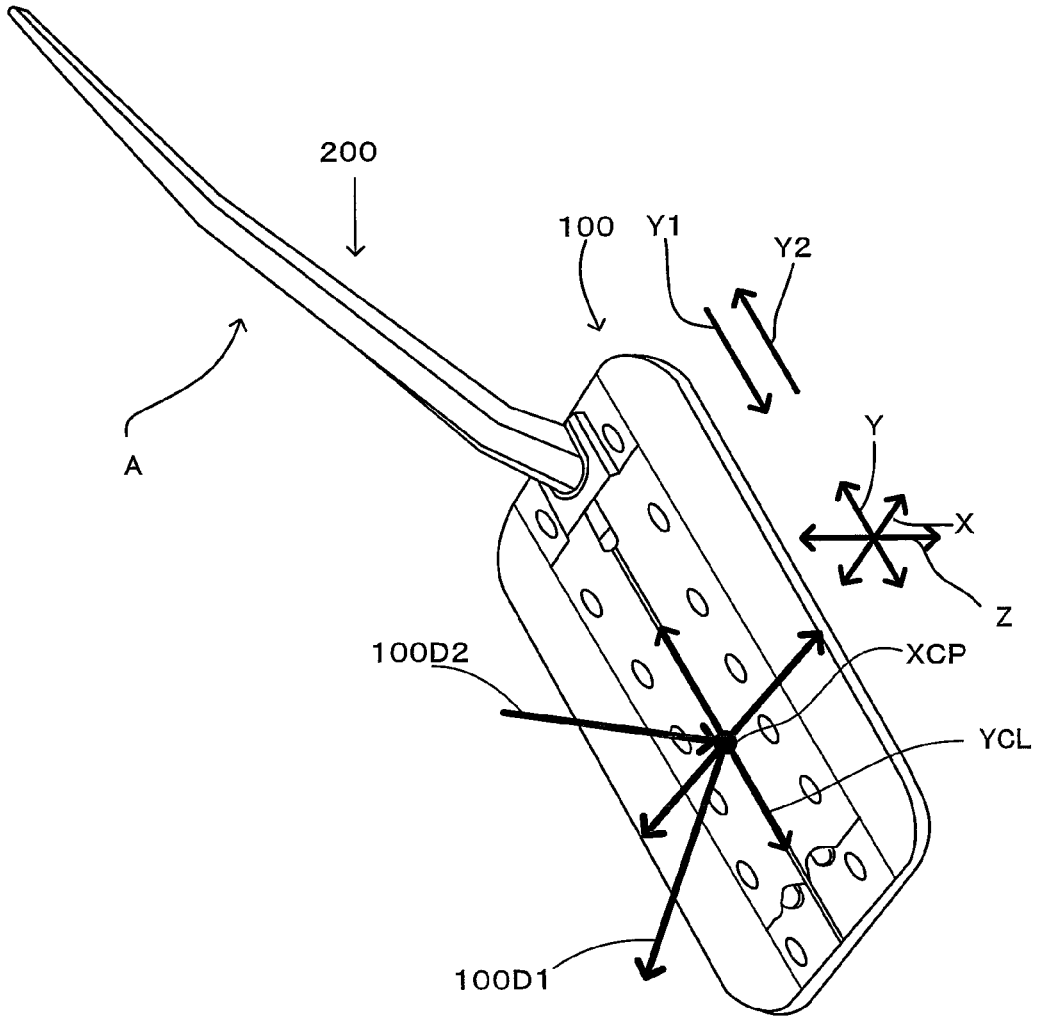
FIG. 1 is a perspective view showing an overall structure of a cleaning tool according to an embodiment of the present invention.

As shown in FIG. 1, the cleaning tool A includes a cleaning element holder 200 and a cleaning element 100. The cleaning element holder 200 is configured to be removably attached to the cleaning element 100 and to hold the cleaning element 100. The cleaning tool A, the cleaning element holder 200 and the cleaning element 100 are example embodiments that correspond to the "cleaning tool", the "holder" and the "cleaning sheet", respectively, according to this invention.

The cleaning element 100 is configured to extend in a longitudinal direction Y and a transverse direction X crossing the longitudinal direction Y. The longitudinal direction Y is defined by a direction parallel to a direction of insertion of the cleaning element holder 200 into the cleaning element 100. The direction of insertion of the cleaning element holder 200 into the cleaning element 100 is defined as an inserting direction Y1, and a direction opposite to the inserting direction Y1 is defined as a pulling-out direction Y2.

A direction crossing the longitudinal direction Y and the transverse direction X is defined as a thickness direction Z. The term "crossing" as used in this specification means "perpendicularly crossing" unless otherwise specified.

The longitudinal direction Y and the transverse direction X are example embodiments that correspond to the "longitudinal direction" and the "transverse direction", respectively, according to this invention.

A center point of the cleaning element 100 in the transverse direction X is defined as a transverse direction center point XCP. The transverse direction center point XCP can be formed on a line passing through any point on the cleaning element 100 in the transverse direction X.

A line passing through the transverse direction center point XCP in parallel to the longitudinal direction Y is defined as a longitudinal center line YCL.

A direction away from the transverse direction center point XCP of the cleaning element 100 is defined as an outside direction 100D1, and a direction toward the transverse direction center point XCP of the cleaning element 100 is defined as an inside direction 100D2.

(Structure of the Cleaning Element Holder)

Figure 2:
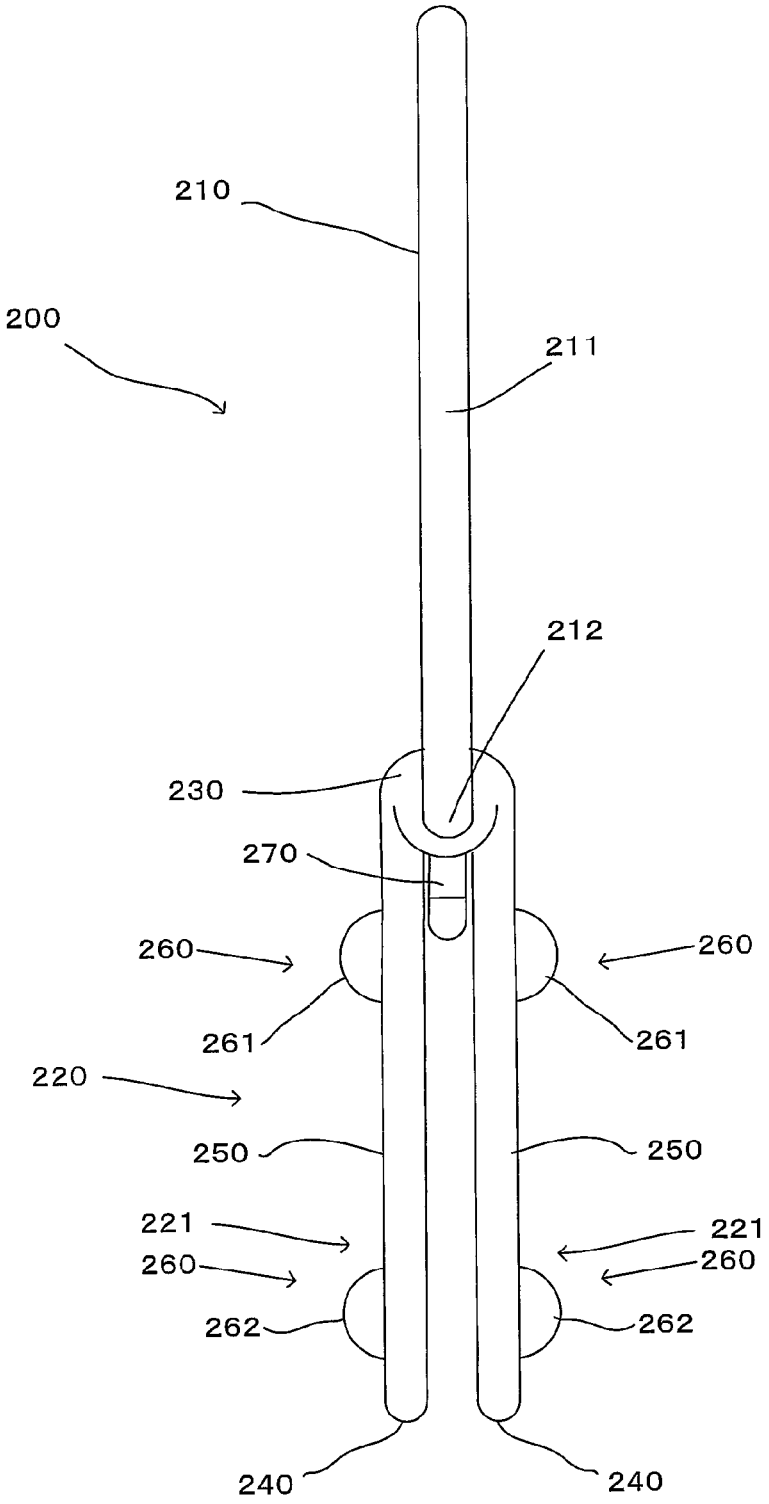
FIG. 2 is a plan view of a cleaning element holder.

As shown in FIG. 2, the cleaning element holder 200 mainly includes a handle part 210 and a cleaning element holding part 220. The handle part 210 is an elongate member to be held by a user during cleaning. The handle part 210 has a handle 211 and a handle connecting part 212. The handle connecting part 212 is connected to a connection part 230 of the cleaning element holding part 220. The handle 211 extends in an elongate form from the handle connecting part 212. The handle part 210 and the cleaning element holding part 220 are example embodiments that correspond to the "grip part" and the "holding part", respectively, according to this invention.

The cleaning element holding part 220 is a member formed of resin material and configured to hold the cleaning element 100. The cleaning element holding part 220 mainly includes a pair of elongate holding members 221, a projection 260 and a retaining plate 270. Specifically, polypropylene (PP) is used to form the cleaning element holding part 220. Flexible resin materials, such as polyethylene (PE), polyethylene terephthalate (PET), acrylonitrile butadiene styrene (ABS) and thermoplastic polyester elastomer, can be appropriately selected for the cleaning element holding part 220.

Each of the holding members 221 extends from the connection part 230 in a direction opposite to the direction in which the handle 211 extends. Specifically, the holding member 221 has the connection part 230, a tip part 240 and an intermediate part 250 extending from the connection part 230 to the tip part 240. The tip part 240 of the holding member 221 is a free end.

The projection 260 is formed in the outside direction 100D1 in the intermediate part 250. The projection 260 includes a first projection 261 formed on the connection part 230 side and a second projection 262 formed on the tip part 240 side.

The retaining plate 270 protrudes from the connection part 230 and extends parallel to the pair holding members 221 therebetween. The retaining plate 270 is convexly curved downward, and further has an engagement lug (not shown) on the underside.

(Structure of the Cleaning Element)

Figure 4:
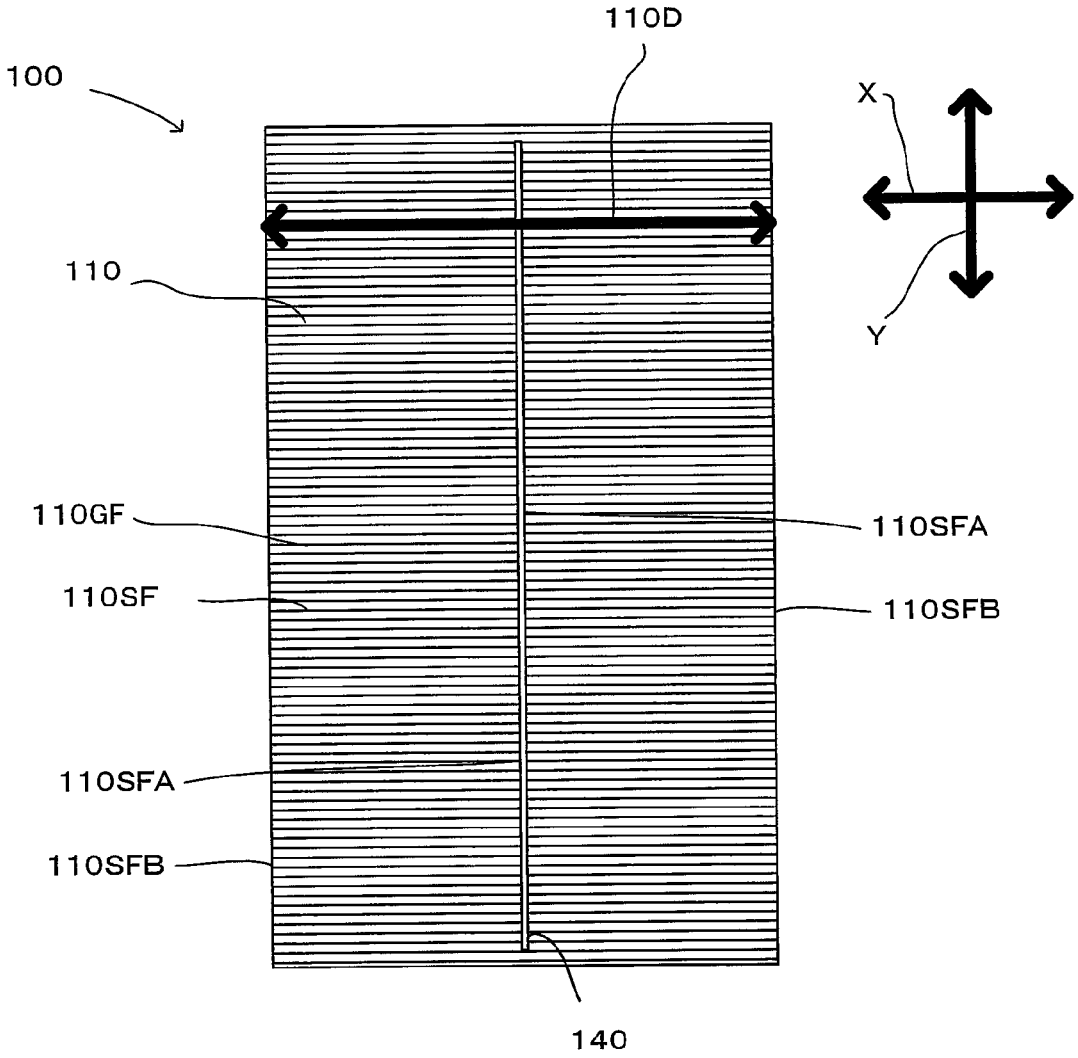
FIG. 4 is a plan view of the cleaning element as viewed from a brush part side.
Figure 5:
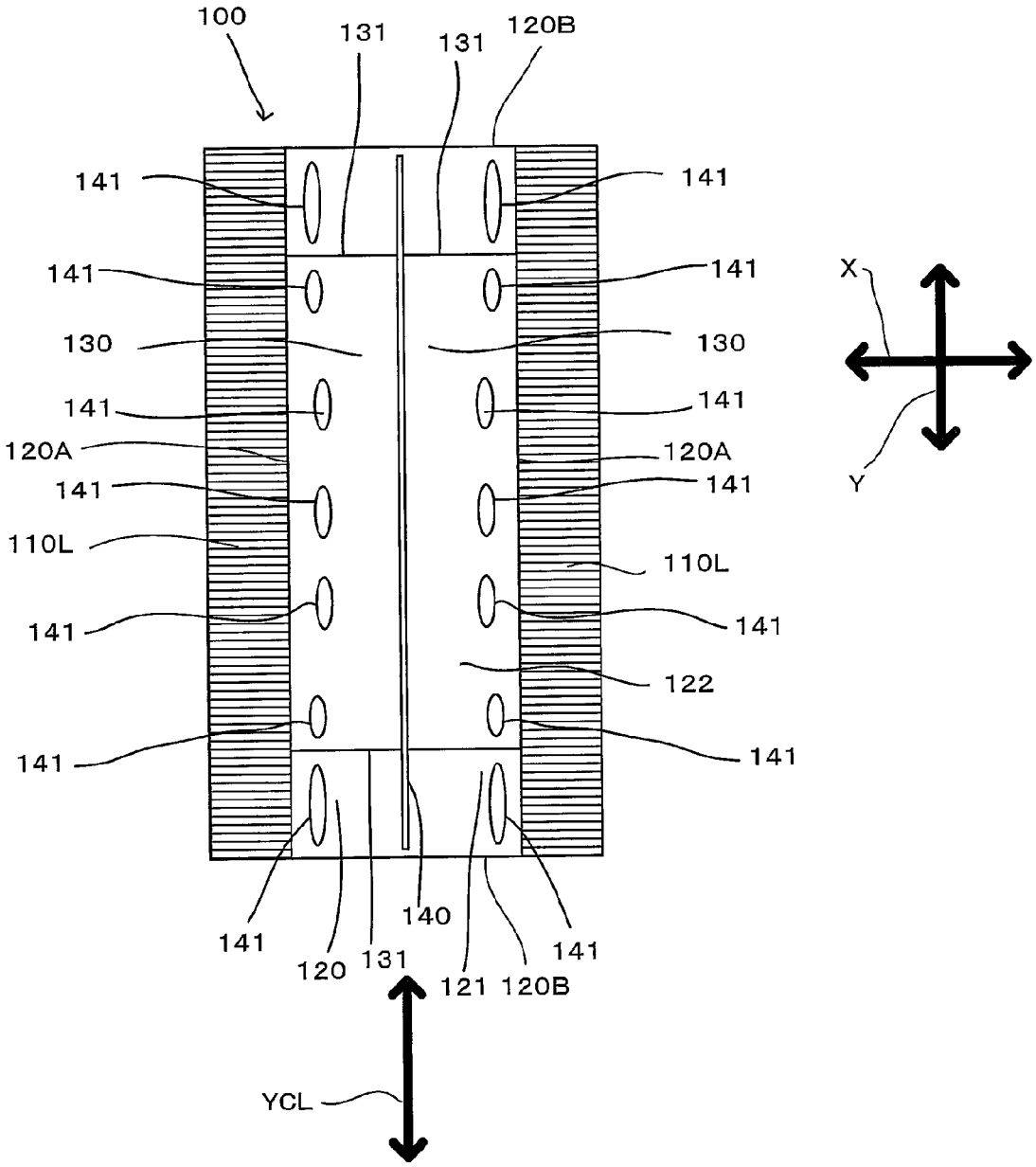
FIG. 5 is a plan view of the cleaning element as viewed from a second sheet element side.

The cleaning element 100 is now explained with reference to FIGS. 3 to 5. The cleaning element 100 has a sheet-like form and has a dirt collecting function of collecting dust or dirt on an object to be cleaned. As shown in FIGS. 4 and 5, the cleaning element 100 is rectangular in plan view.

The cleaning element 100 may be of disposable type designed for single use, disposable type designed for multiple use which can be used several times, while holding dust or dirt collected from the cleaning surface to be cleaned, or reusable type which can be reused by washing.

A base 120 of the cleaning element 100 is formed by a first sheet element 121. The base 120 has ends 120A in the transverse direction X and ends 120B in the longitudinal direction Y, and one side 120C and the other side 120D. The base 120, the first sheet element 121, the one side 120C and the other side 120D are example embodiments that correspond to the "base", the "first sheet element", the "one side" and "the other side", respectively, according to this invention.

A fiber assembly 110GF is disposed on the one side 120C of the base 120. A second sheet element 122 is disposed on the other side 120D of the base 120.

The base 120, the fiber assembly 110GF and the second sheet element 122 which are thus superposed one on the other extend in an elongate form in the longitudinal direction Y of the cleaning element 100.

The fiber assembly 110GF forms a brush part 110 having a dirt collecting function. The fiber assembly 110GF and the brush part 110 are example embodiments that correspond to the "fiber assembly" and the "brush part", respectively, according to this invention.

The fiber assembly 110GF is formed by an assembly of fibers 110SF. In this invention, the fiber 110SF is a single fiber structure formed by typical fibers, a fiber structure having typical fibers aligned in the length direction and/or the radial direction (twist yarn, spun yarn, yarn to which a plurality of filaments are partially connected), or an assembly of the fiber structures. The "typical fibers" as used herein are components of yarn, textile or the like and are thin and flexible fibers having a substantially longer length compared with the thickness. Typically, a long continuous fiber is defined as a filament and a short fiber as a staple.

The fibers 110SF contain thermoplastic fibers in part and can be fusion bonded (or welded).

The fiber assembly 110GF is formed of fibers 110SF which are arranged side by side along a prescribed direction of fiber orientation 110D and stacked in the thickness direction Z. In this embodiment, the direction of fiber orientation 110D substantially coincides with the transverse direction X. The fibers 110SF are flexible and thus easily bent and deformed. Therefore, the direction of fiber orientation 110D of the fibers 110SF refers to the fiber orientation in design of the product.

The fibers 110SF of the fiber assembly 110GF have a connection end 110SFA which is welded to a central bonded part 140. Further, the fibers 110SF have an open end 110SFB on the opposite side to the connection end 110SFA. The open end 110SFB is a free end.

Figure 3:
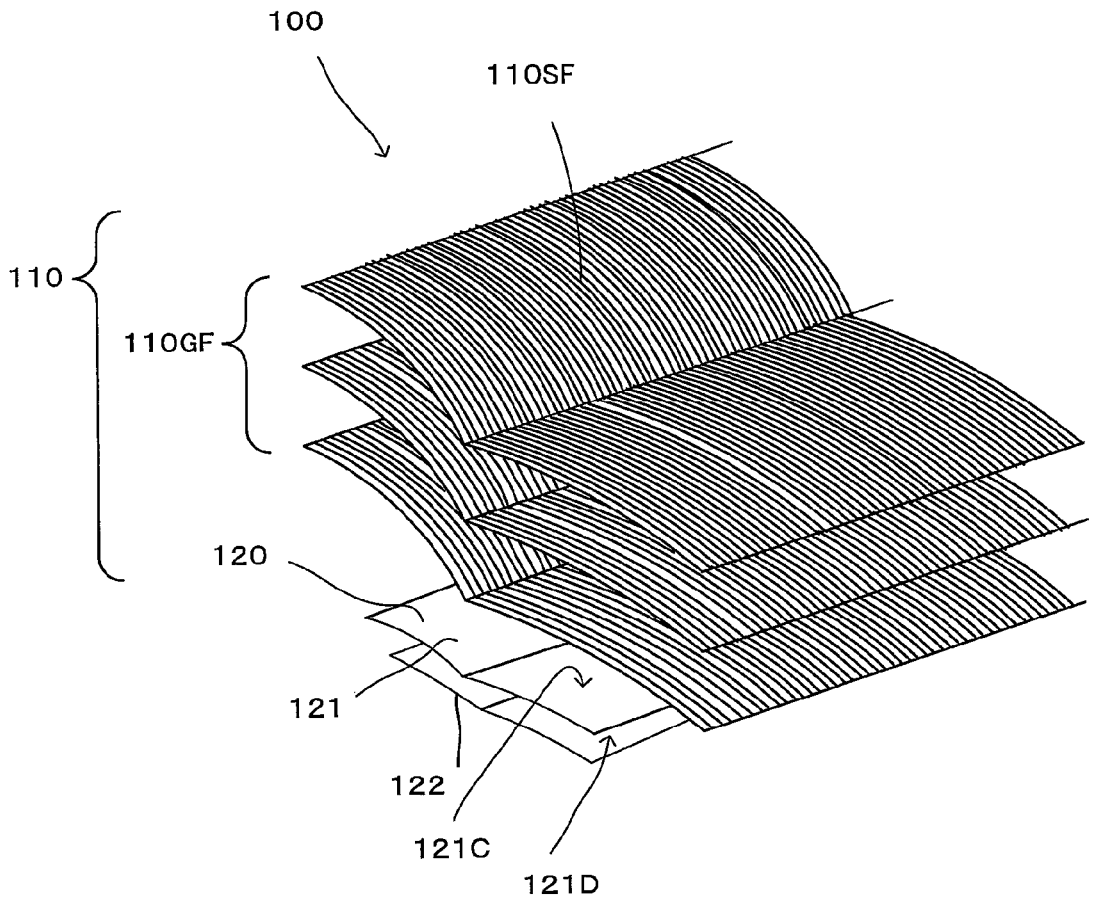
FIG. 3 is a perspective view of a cleaning element, in a state separated into elements.

In FIG. 3, the fiber assembly 110GF is formed by three fiber layers, but the number of fiber layers may be one or more other than three as necessary. Preferably, the fiber assembly 110GF has a planar structure having a predetermined flat or curved surface and has a three-dimensional form having a certain thickness or has a thin sheet-like form. The fiber assembly 110GF is typically formed of polyethylene (PE), polypropylene (PP), polyethylene terephthalate (PET), nylon, rayon or the like. In practical use, an assembly of filaments formed by opening a tow is preferably used as the fiber assembly 110GF. It is particularly preferable that the fiber assembly 110GF comprises conjugated fibers having a core of polypropylene (PP) or polyethylene terephthalate (PET) and a core covering sheath of polyethylene (PE). Further, the fibers 110SF of the fiber assembly 110GF preferably have a fineness of 1 to 50 dtex, or more preferably 2 to 10 dtex. Each fiber assembly may contain fibers of substantially the same fineness, or it may contain fibers of different finenesses.

Further, in order to enhance the dirt collecting function in cleaning, oil is applied to the fiber assembly 110GF. The oil is mainly composed of liquid paraffin.

Further, in order to enhance the sweeping-out function in cleaning, it is preferred to use the fiber assembly 110GF including the fibers 110SF having higher rigidity or the fibers 110SF having higher fineness. It is further preferred that the fiber assembly 110GF has crimped fibers. Here, the crimped fibers are fibers subjected to a prescribed crimping process and easily intertwined with each other. By using such crimped fibers, the fiber assembly 110GF becomes bulkier than before the cleaning element holder 200 is attached to the cleaning element, and dust can be easily captured by the crimped portions. This structure can be realized especially by using crimped fibers opened from tows.

As shown in FIG. 5, the second sheet element 122 is a rectangular nonwoven fabric sheet which is shorter than the base 120 in the longitudinal direction Y.

The base 120 (the first sheet element 121) and the second sheet element 122 are typically formed of sheet-like nonwoven fabric comprising thermal melting fibers (thermoplastic fibers). Therefore, the base 120 and the second sheet element 122 are also referred to as "nonwoven fabric sheet". In order to enhance the sweeping-out function in cleaning, it is preferred to use the nonwoven fabric having higher rigidity.

The nonwoven fabric is formed of synthetic fibers such as polyethylene (PE), polypropylene (PP) and polyethylene terephthalate (PET). Further, the nonwoven fabric is manufactured by through-air bonding or spun bonding.

Not only the nonwoven fabric, however, cloth or synthetic resin film may also be used.

The base 120 and the second sheet element 122 are welded at the central bonded part 140 extending along the longitudinal center line YCL of the cleaning element 100, and at a plurality of first bonded parts 141 arranged on the both sides of the central bonded part 140. Specifically, as shown in FIG. 5, the base 120, the second sheet element 122 and the fiber assembly 110GF are welded at the central bonded part 140. Further, the base 120, the second sheet element 122 and part of the fiber assembly 110GF are welded at the first bonded parts 141. The first bonded parts 141 located on the both end regions in the longitudinal direction Y are formed in positions where the second sheet element 122 does not exist. Therefore, the first bonded parts 141 located on the both end regions in the longitudinal direction Y only bond the base 120 and part of the fiber assembly 110GF.

A pair of holding spaces 130 are formed between the base 120 and the second sheet element 122 in a region between the central bonded part 140 and the first bonded parts 141 and extend in the longitudinal direction Y. Each of the holding spaces 130 has openings 131 on the both ends in the longitudinal direction Y. The holding space 130 is an example embodiment that corresponds to the "insertion part" according to this invention.

In other words, the holding spaces 130 are defined by a prescribed region of the base 120 and a prescribed region of the second sheet element 122 which extend between the pair first bonded parts 141 in the transverse direction X.

The first bonded parts 141 are continuously formed substantially along the longitudinal direction Y. It is not necessary for adjacent ones of the first bonded parts 141 in the longitudinal direction Y to be aligned in the longitudinal direction Y. The arrangement pattern of the first bonded parts 141 can be appropriately designed according to the design and the shape of the cleaning element holding part 220. Naturally, the first bonded part 141 may also be formed in a continuous linear shape.

The central bonded part 140 and the first bonded parts 141 are formed by heat welding.

The bonded parts according to this invention may also be formed by ultrasonic welding, sewing or adhesives such as a hot-melt adhesive.

The brush part 110 is longer than the base 120 and the second sheet element 122 in the transverse direction. A part of the brush part 110 which protrudes from the base 120 is defined as an extending region 110L. The extending region 110L is an example embodiment that corresponds to the "extending region" according to this invention.

(Engagement of the Cleaning Element Holder and the Cleaning Element)

Figure 6:
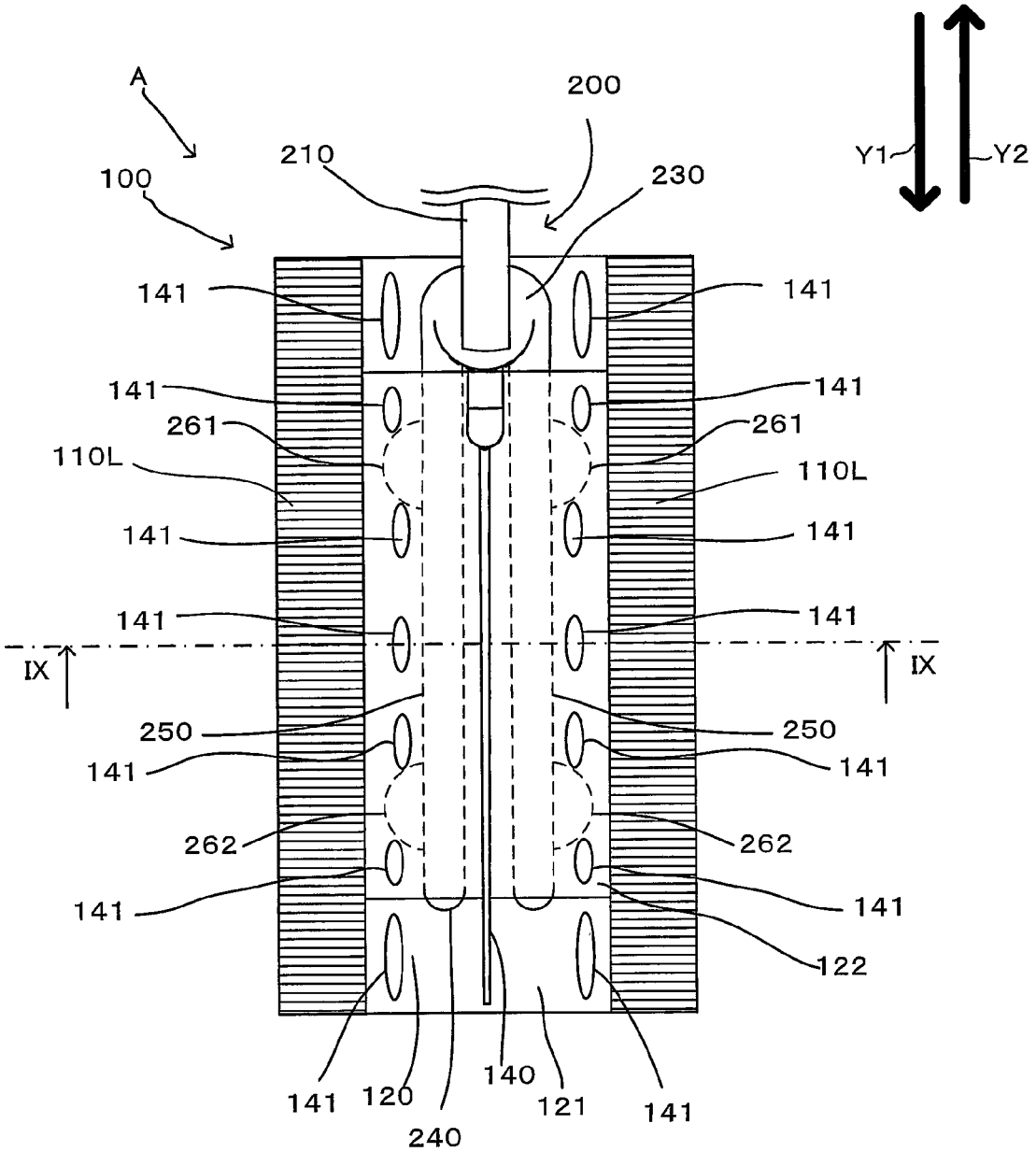
FIG. 6 shows engagement of the cleaning element holder with the cleaning element.
Figure 7:
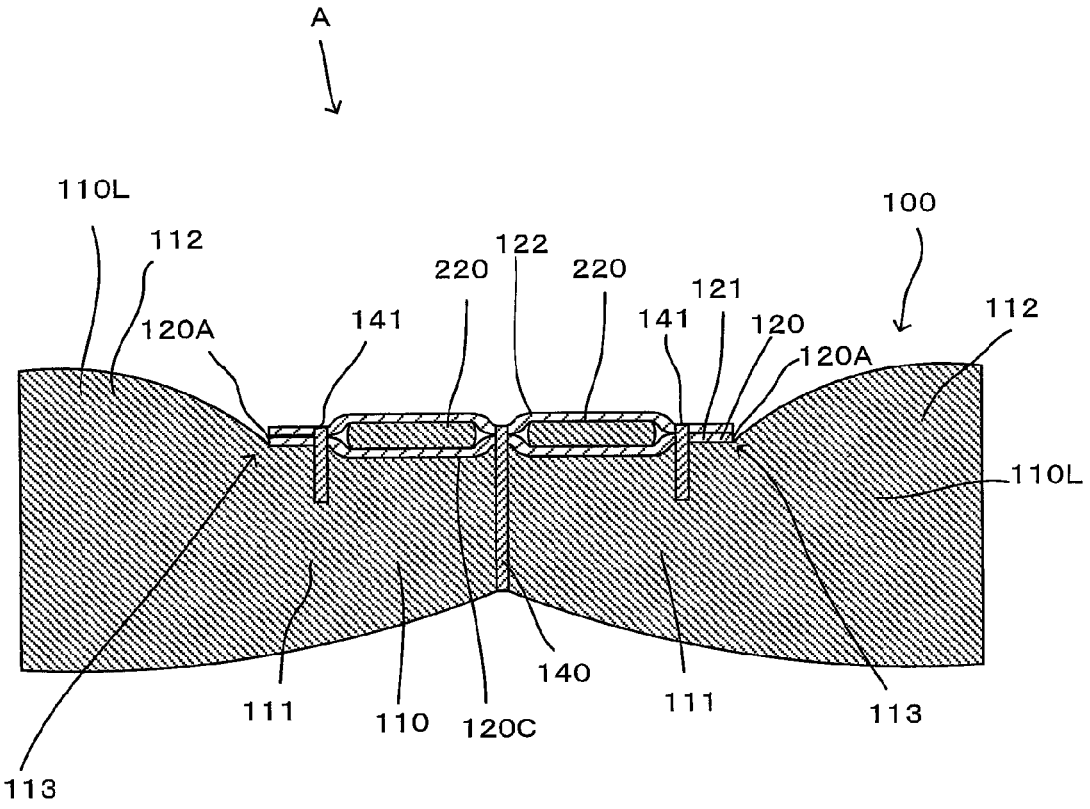
FIG. 7 is a sectional view taken along line IX-IX in FIG. 6.

Engagement of the cleaning element holder 200 and the cleaning element 100 is explained with reference to FIGS. 6 and 7. As shown in FIG. 6, the holding members 221 can be inserted into the holding spaces 130. The cleaning element 100 is held by the cleaning element holder 200 by inserting the holding members 221 into the holding spaces 130 along the inserting direction Y1. In order to disengage the cleaning element holder 200 and the cleaning element 100 from each other, the cleaning element holder 200 is pulled out of the holding spaces 130 along the pulling-out direction Y2.

When the cleaning element holder 200 and the cleaning element 100 are engaged with each other, the projection 260 is located between the adjacent first bonded parts 141. As a result, the engagement between the cleaning element holder 200 and the cleaning element 100 is reliably maintained.

Further, the second sheet element 122 is held between the retaining plate 270 and the holding members 221.

(Operation)

Figure 8:
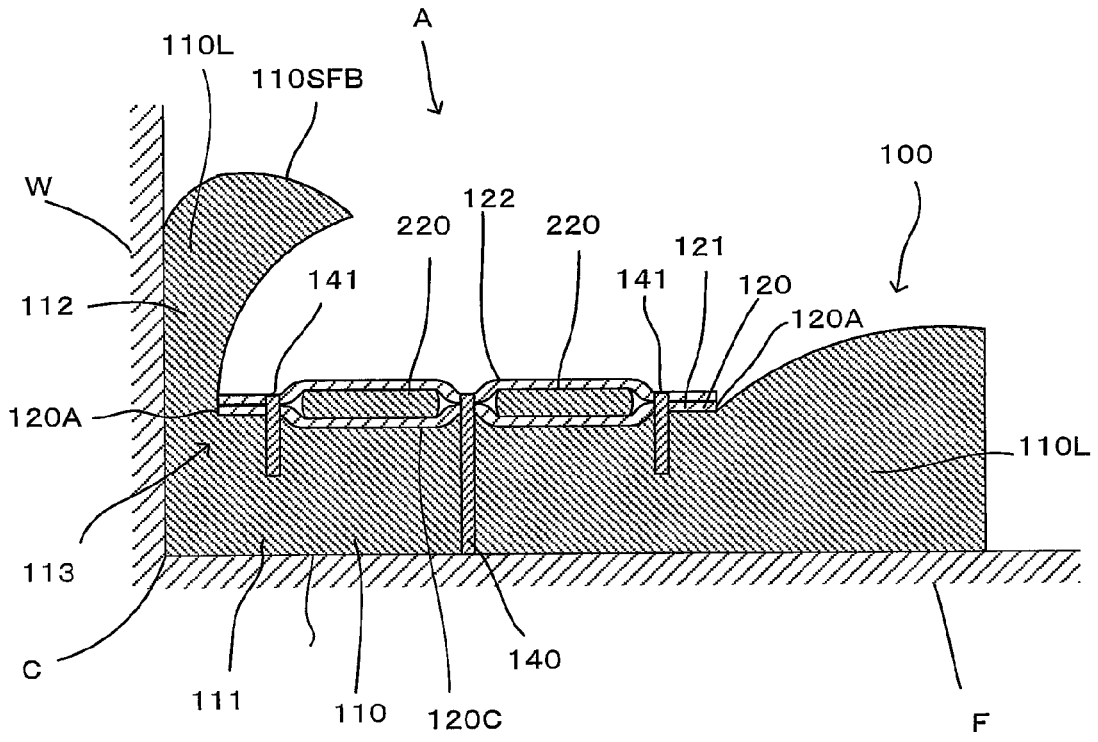
FIG. 8 is an explanatory drawing for illustrating the cleaning tool in use.

Operation of the cleaning tool A according to this embodiment is now explained with reference to FIG. 8.

When cleaning, a user holds the handle 211 of the handle part 210 and puts the cleaning element 100 in contact with an object to be cleaned. Then the user can capture or sweep dust or dirt of an object to be cleaned with the brush part 110.

Further, when, for example, a corner part C between a floor F and a wall W is to be cleaned, the user puts the brush part 110 in contact with the floor F and put an end portion of the brush part 110 in the transverse direction X in contact with the wall W. Then, free end portions 110SFB of the fibers 110SF in the extending region 110L are turned in a direction away from the floor F. When the user further moves the brush part 110 in this direction, the free end portions 110SFB of the fibers 110SF are further moved in a direction away from the floor F. As a result, the extending region 110L comes into contact with the wall W. The fiber assembly 110GF forming the brush part 110 is bent and forms a bending region 113. The bending region 113 comes into contact with the corner part C. The bending region 113 is an example embodiment that corresponds to the "bending region", according to this invention.

Thus, the user can clean the floor F, the wall W and the corner part C with the cleaning tool A.

When cleaning the corner part C as described above, the fiber assembly 110GF is bent with an end 120A of the base 120 in the transverse direction X as a starting point. Specifically, the extending region 110L of the fiber assembly 110GF is not overlapped on the base 120. Therefore, the extending region 110L is allowed to largely bend.

Although the extending region 110L is bent with the end 120A of the base 120 as a starting point, the base 120 which is formed of relatively flexible materials such as non-woven fabrics may also be bent by user's application of pressure during cleaning. Even if the base 120 is bent, the cleaning tool is considered as constituting the present invention if the extending region 110L is allowed to bend, with the end 120A of the base 120 as a starting point, more largely than the region on which the base 120 is disposed.

The brush part 110 forms a first cleaning region 111 and a second cleaning region 112 between which the bending region 113 is formed. The first cleaning region 111 and the second cleaning region 112 are example embodiments that correspond to the "first cleaning region" and the "second cleaning region", respectively, according to this invention. The first cleaning region 111 is formed in an overlapped part of the brush part 110 on the base 120, and the second cleaning region 112 is formed in a part of the brush part 110 which is not overlapped on the base 120, or in the extending region 110L.

The first cleaning region 111, the second cleaning region 112 and the bending region 113 have a first cleaning surface 111A, a second cleaning surface 112A and a bending cleaning surface 113A, respectively, all of which can come in contact with an object to be cleaned.

An extending direction of the first cleaning surface 111A coincides with an extending direction of the second cleaning surface 112A.

The "fiber assembly is bent" in this invention means that part of the fiber assembly 110GF is folded, deformed, curved or otherwise made uneven by an external force.

The present invention is not limited to the above-described embodiment, but rather, may be added to, changed, replaced with alternatives or otherwise modified. For example, in the cleaning tool A of the above-described embodiment, the holder 200 is provided with the two holding members 221, and correspondingly the cleaning element 100 is provided with the two holding spaces 130. However, a single holding space 130 may be provided for the two holding members 221, or a single holding member 221 and a single holding space 130 may be provided.

Now, modifications to the above-described embodiment are explained. Components identical or corresponding to those in the cleaning tool A of the above-described embodiment are given like numerals and are not described.

(First Modification)

Figure 9:
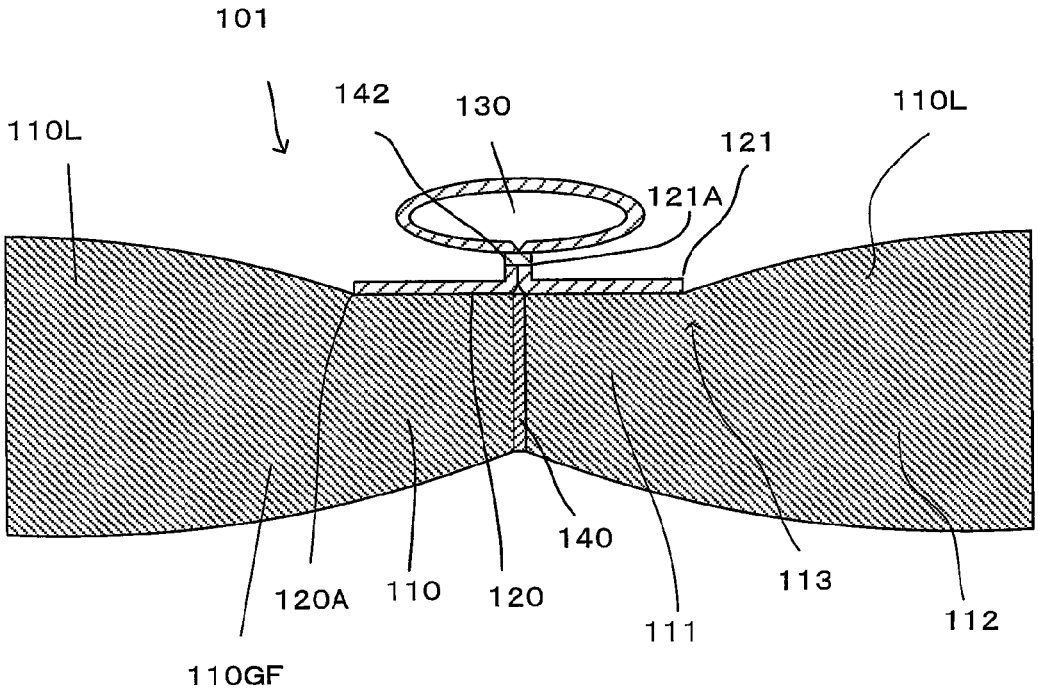
FIG. 9 is an explanatory drawing of a cleaning element according to a first modification of the present invention.

A first modification is explained with reference to FIG. 9. A cleaning element 101 of the first modification is different in the structure of the holding space 130 from the cleaning element 100 of the above-described embodiment.

In the cleaning element 101 of the first modification, the holding space 130 is formed only by the first sheet element 121 forming the base 120. Specifically, a bonding sheet region 121A is formed by contact of prescribed surfaces of the first sheet element 121 with each other. A prescribed area of the bonding sheet region 121A is then welded to form a second bonded part 142.

In this manner, the holding space 130 extending in the longitudinal direction Y is formed.

In the first modification, the central bonded part 140 bonds only the brush part 110. The brush part 110 and the base 120 can be bonded together, for example, by an adhesive (not shown).

In the cleaning element 101 of the first modification, the extending region 110L is formed in the brush part 110, so that the same effect as the cleaning element 100 of the above-described embodiment can be obtained.

(Second Modification)

Figure 10:
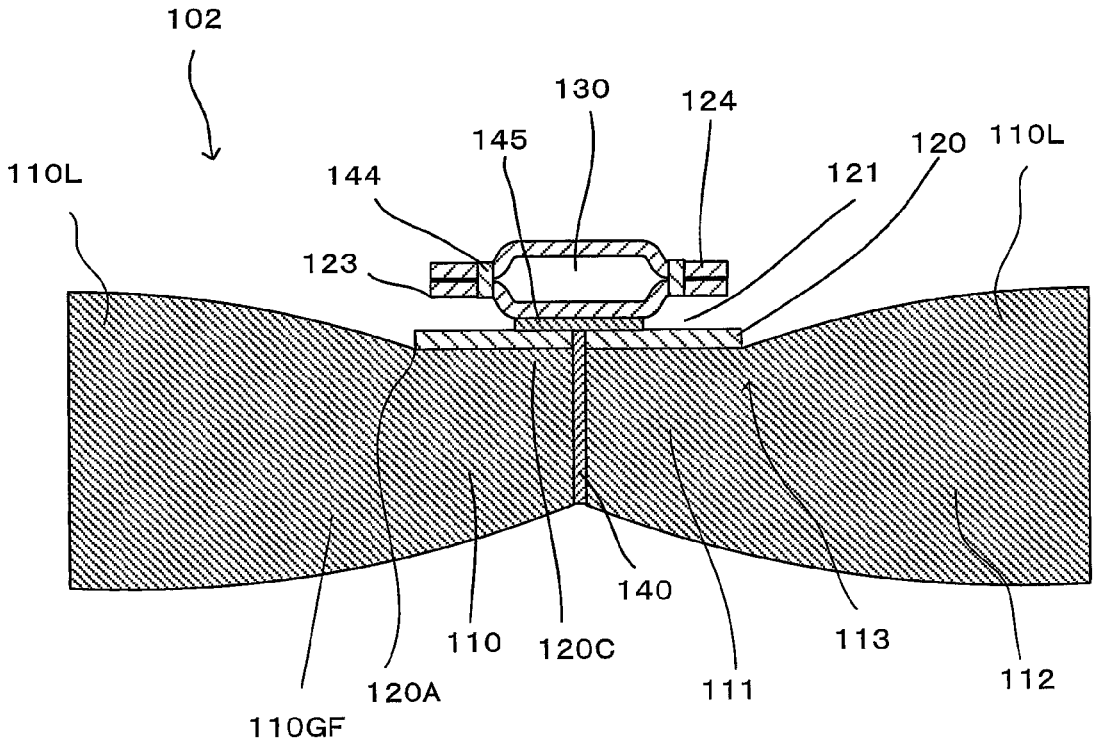
FIG. 10 is an explanatory drawing of a cleaning element according to a second modification of the present invention.

A second modification is explained with reference to FIG. 10. A cleaning element 102 of the second modification is different in the structure of the holding space 130 from the cleaning element 100 of the above-described embodiment.

In the cleaning element 102 of the second modification, the holding space 130 is formed separately from the base 120. A third sheet element 123 and a fourth sheet element 124 are superposed. Regions of the third sheet element 123 and the fourth sheet element 124 close to their ends in the transverse direction X are then welded together along the longitudinal direction Y to form a fourth bonded part 144.

In this manner, the holding space 130 extending in the longitudinal direction Y can be formed between the third sheet element 123 and the fourth sheet element 124.

In the second modification, the central bonded part 140 bonds only the brush part 110 and the base 120. The third sheet element 123 is bonded to the base 120, for example, by an adhesive, to form a fifth bonded part 145.

In the cleaning element 102 of the second modification, the extending region 110L is formed in the brush part 110, so that the same effect as the cleaning element 100 of the above-described embodiment can be obtained.

(Third Modification)

Figure 11:
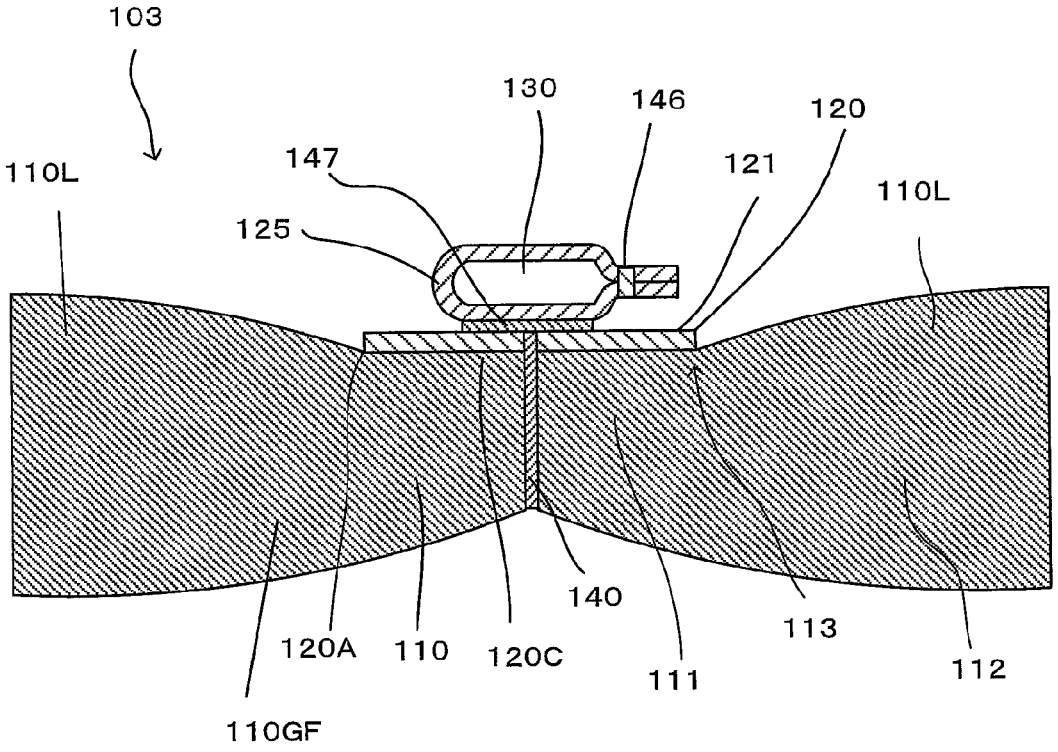
FIG. 11 is an explanatory drawing of a cleaning element according to a third modification of the present invention.

A third modification is explained with reference to FIG. 11. A cleaning element 103 of the third modification is different in the structure of the holding space 130 from the cleaning element 100 of the above-described embodiment.

In the cleaning element 103 of the third modification, the holding space 130 is formed separately from the base 120. Specifically, a bonding sheet region 125A is formed by contact of prescribed surfaces of a fifth sheet element 125 with each other. A prescribed area of the bonding sheet region 125A is then welded to form a sixth bonded part 146.

In this manner, the holding space 130 extending in the longitudinal direction Y is formed.

In the third modification, the central bonded part 140 bonds only the brush part 110 and the base 120. The fifth sheet element 125 is bonded to the base 120, for example, by an adhesive, to form a seventh bonded part 147.

In the cleaning element 103 of the third modification, the extending region 110L is formed in the brush part 110, so that the same effect as the cleaning element 100 of the above-described embodiment can be obtained.

(Fourth Modification)

Figure 12:
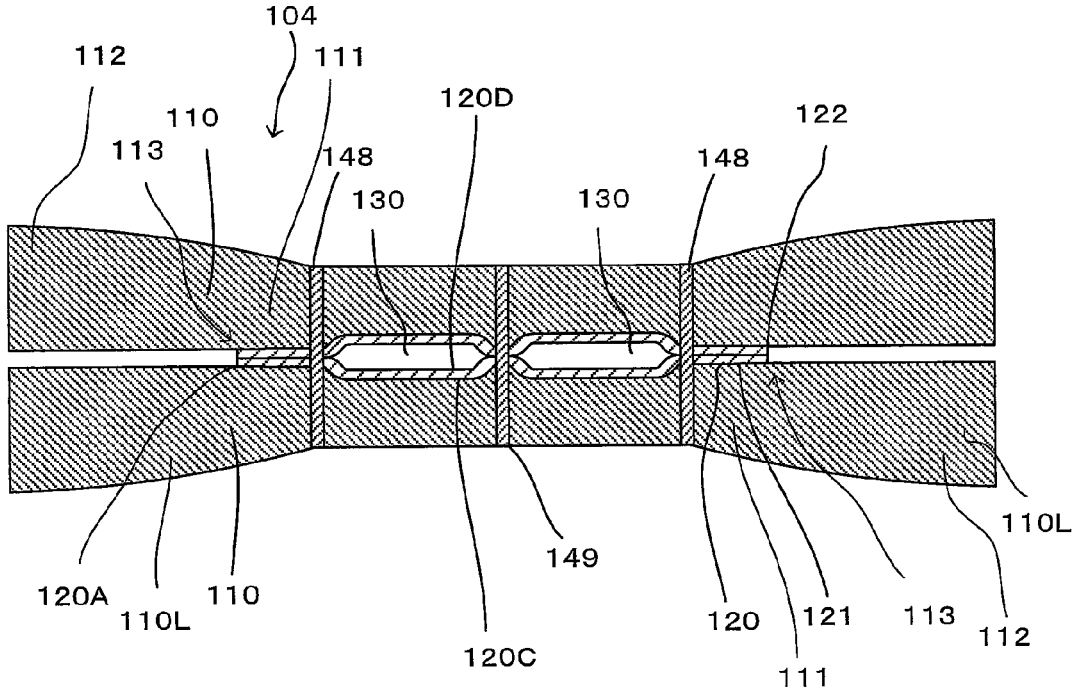
FIG. 12 is an explanatory drawing of a cleaning element according to a fourth modification of the present invention.

A fourth modification is explained with reference to FIG. 12. A cleaning element 104 of the fourth modification is different from the cleaning element 100 of the above-described embodiment in that the brush part 110 is formed not only on the one side 120C of the base 120, but also on the other side 120D of the base 120.

Specifically, the fiber assembly 110GF is superposed on the one side 120C of the base 120, and the second sheet element 122 and the fiber assembly 110GF are superposed on the other side 120D of the base 120. Thus, a laminate in which the base 120 and the second sheet element 122 are sandwiched by the two fiber assemblies 110GF is formed. In this laminate, end regions of the base 120 and the second sheet element 122 in the transverse direction X are welded to form a pair of eighth bonded parts 148. Further, the laminate is welded in a region between the eighth bonded parts 148 to form a ninth bonded part 149. In this manner, the cleaning element 104 is formed.

In the cleaning element 104 of the fourth modification, the extending region 110L is formed in the brush part 110, so that the same effect as the cleaning element 100 of the above-described embodiment can be obtained.

Further, by providing the brush part 110 on the other side 120D of the base 120 as well, the user convenience is enhanced.

(Fifth Modification)

Figure 13:
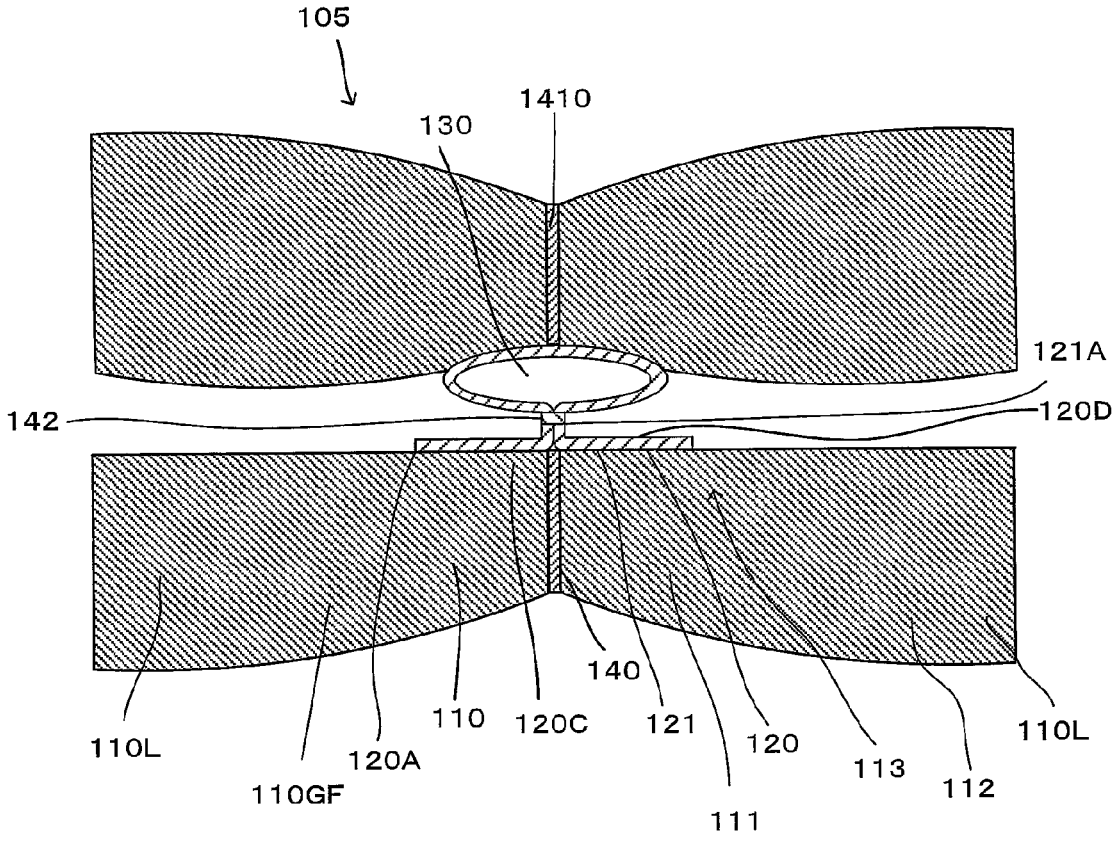
FIG. 13 is an explanatory drawing of a cleaning element according to a fifth modification of the present invention.

A fifth modification is explained with reference to FIG. 13. A cleaning element 105 of the fifth modification is different from the cleaning element 101 of the above-described first modification in that the brush part 110 is formed not only on the one side 120C of the base 120, but also on the other side 120D of the base 120.

Specifically, the fiber assembly 110GF is bonded to the first sheet element 121 which forms the holding space 130. The fiber assembly 110GF on the other side 120D of the base 120 is welded at the central region. This welded part forms a tenth bonded part 1410. The fiber assembly 110GF having the tenth bonded part 1410 is then bonded to the first sheet element 121 forming the holding space 130, for example, by an adhesive (not shown). In this manner, the cleaning element 105 is formed.

In the cleaning element 105 of the fifth modification, the extending region 110L is formed in the brush part 110, so that the same effect as the cleaning element 100 of the above-described embodiment can be obtained.

Further, by providing the brush part 110 on the other side 120D of the base 120 as well, the user convenience is further enhanced compared with the cleaning element 101 of the above-described first modification.

(Sixth Modification)

Figure 14:
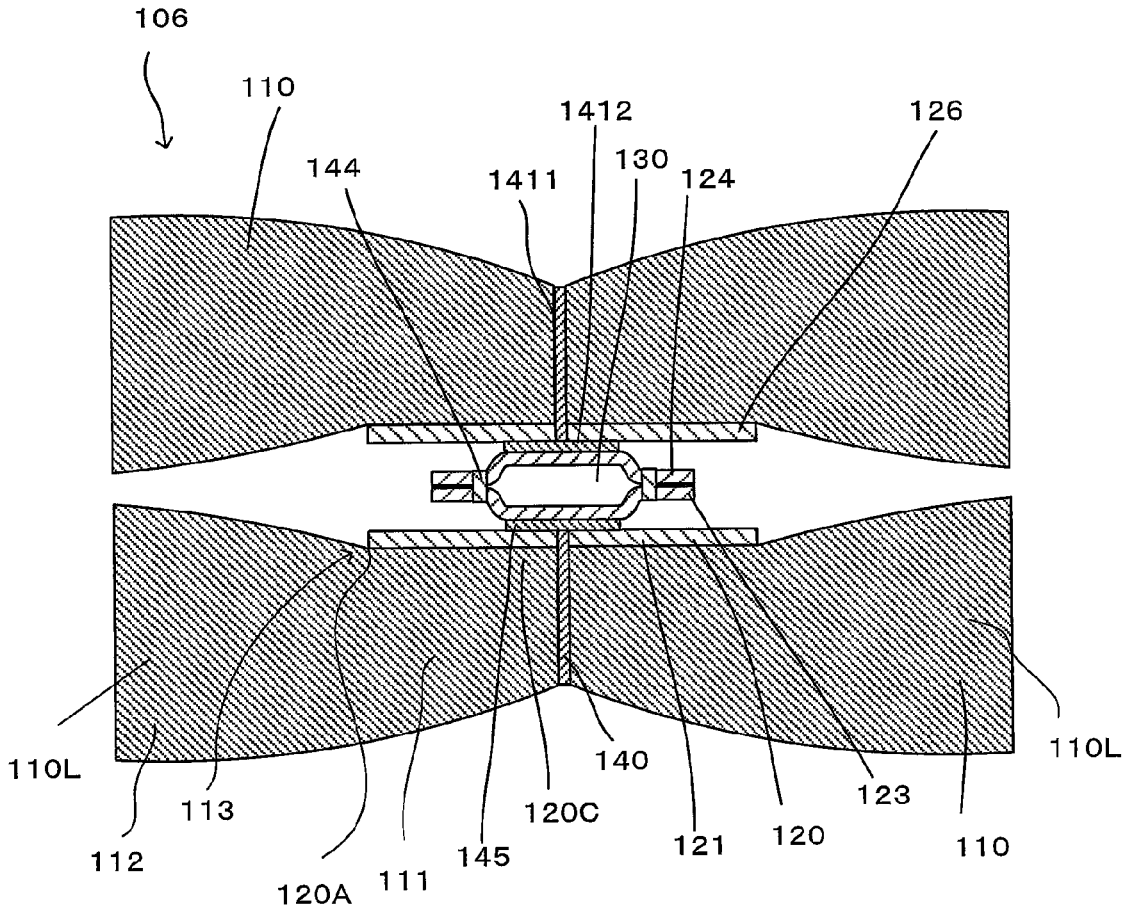
FIG. 14 is an explanatory drawing of a cleaning element according to a sixth modification of the present invention.

A sixth modification is explained with reference to FIG. 14. A cleaning element 106 of the sixth modification is different from the cleaning element 102 of the above-described second modification in that the brush part 110 is formed not only on the one side 120C of the base 120, but also on the other side 120D of the base 120.

Specifically, the fiber assembly 110GF and a sixth sheet element 126 are welded together at the central region to form an 11th bonded part 1411. A side of the sixth sheet element 126 on which the fiber assembly 110GF is not disposed is bonded to the fourth sheet element 124, for example, by an adhesive, to form a 12th bonded part 1412. In this manner, the cleaning element 106 is formed.

In the cleaning element 106 of the sixth modification, the extending region 110L is formed in the brush part 110, so that the same effect as the cleaning element 100 of the above-described embodiment can be obtained.

Further, by providing the brush part 110 on the other side 120D of the base 120 as well, the user convenience is further enhanced compared with the cleaning element 102 of the above-described second modification.

(Seventh Modification)

Figure 15:
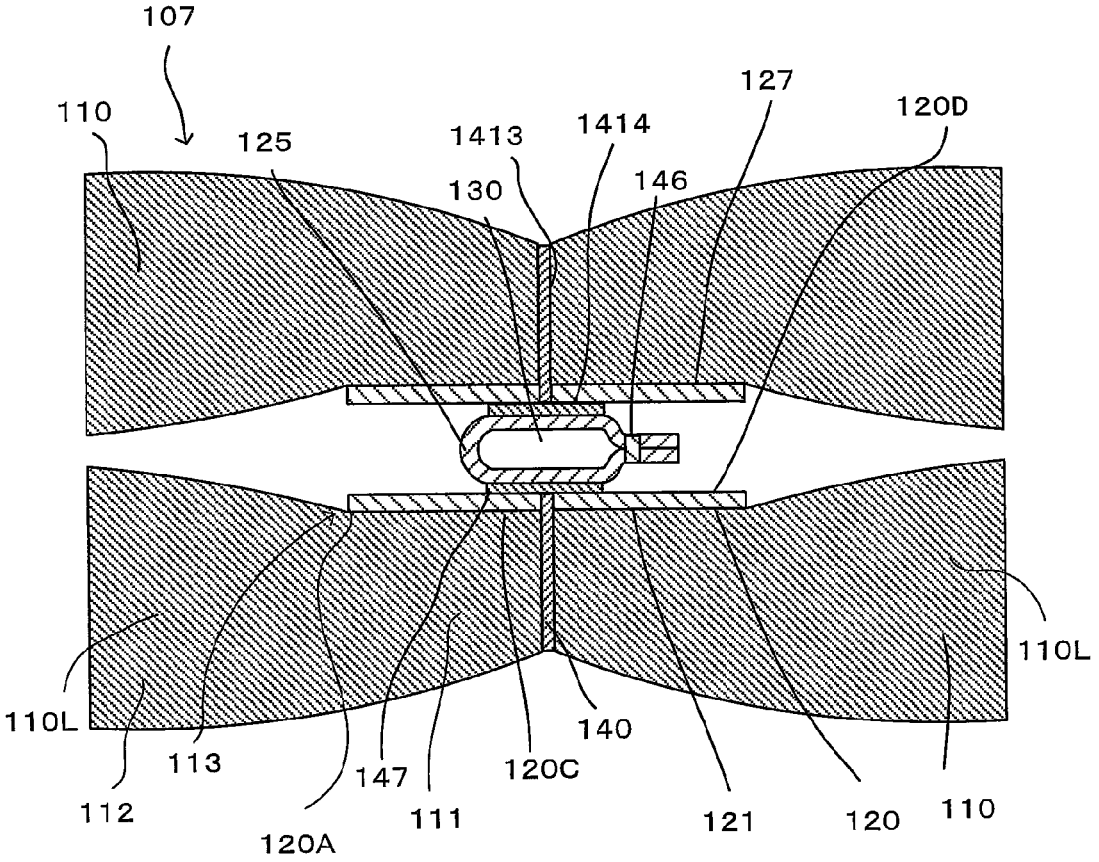
FIG. 15 is an explanatory drawing of a cleaning element according to a seventh modification of the present invention.

A seventh modification is explained with reference to FIG. 15. A cleaning element 107 of the seventh modification is different from the cleaning element 103 of the above-described third modification in that the brush part 110 is formed not only on the one side 120C of the base 120, but also on the other side 120D of the base 120.

Specifically, the fiber assembly 110GF and a seventh sheet element 127 are welded together at the central region to form a 13th bonded part 1413. A side of the seventh sheet element 127 on which the fiber assembly 110GF is not disposed is bonded to the fifth sheet element 125, for example, by an adhesive, to form a 14th bonded part 1414. In this manner, the cleaning element 107 is formed.

In the cleaning element 107 of the seventh modification, the extending region 110L is formed in the brush part 110, so that the same effect as the cleaning element 100 of the above-described embodiment can be obtained.

Further, by providing the brush part 110 on the other side 120D of the base 120 as well, the user convenience is further enhanced compared with the cleaning element 103 of the above-described third modification.

(Eighth Modification)

Figure 16:
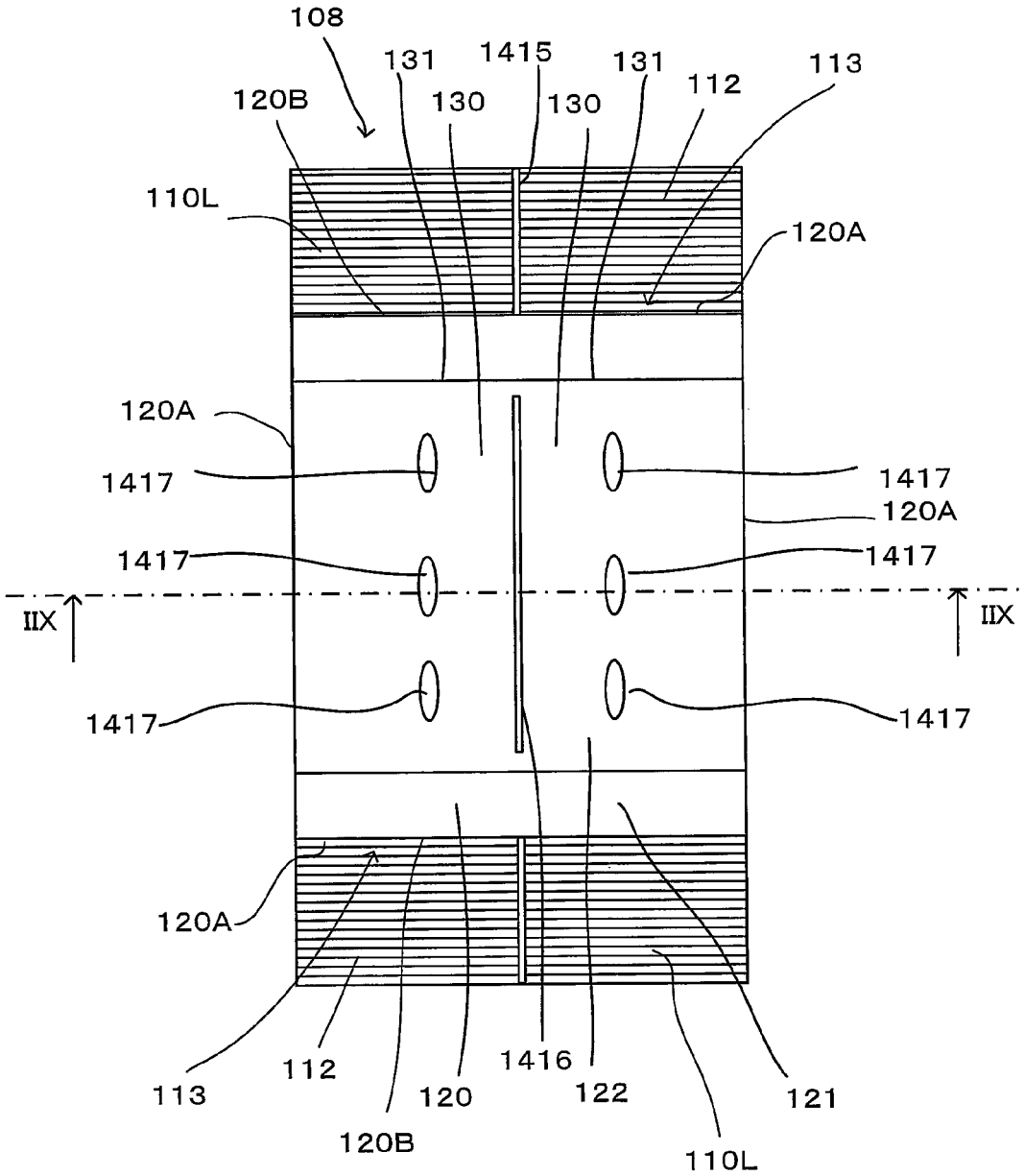
FIG. 16 is an explanatory drawing of a cleaning element according to an eighth modification of the present invention.
Figure 17:
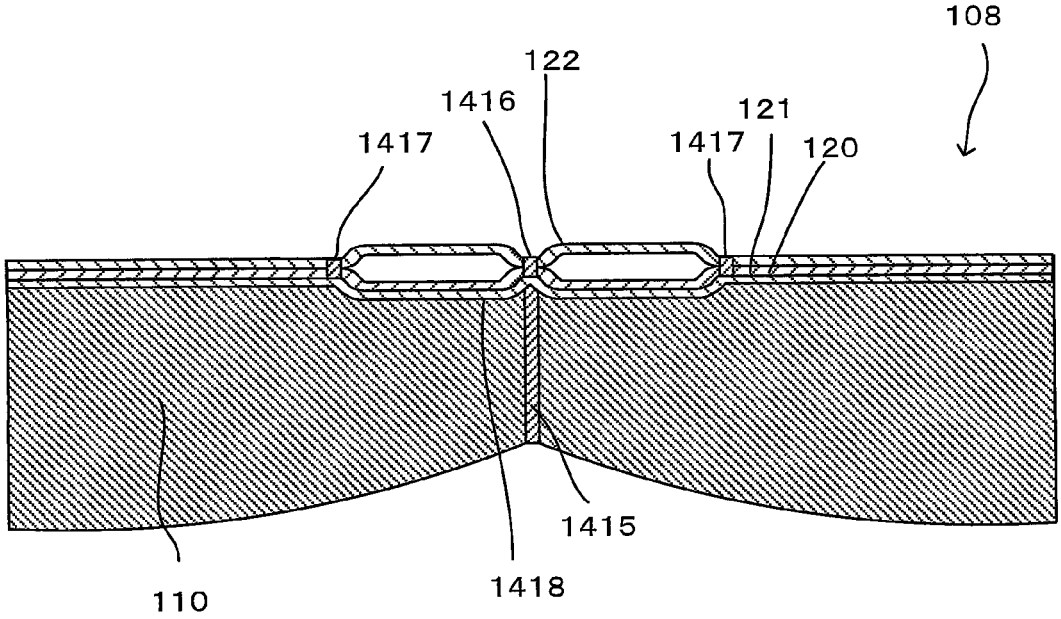
FIG. 17 is a sectional view taken along line IIX-IIX in FIG. 16.

An eighth modification is explained with reference to FIGS. 16 and 17. A cleaning element 108 of the eighth modification is different from the cleaning element 100 of the above-described embodiment in that the extending region 110L is formed on the end 120B sides of the base 120 in the longitudinal direction Y.

Specifically, the base 120, the second sheet element 122 and the brush part 110 have the same length in the transverse direction X. In the longitudinal direction Y, however, the brush part 110 is longer than the base 120 and the second sheet element 122.

The fiber assembly 110GF of the brush part 110 is welded at the central region to form a 15th bonded part 1415.

The base 120 and the second sheet element 122 are welded together at their central regions to form a 16th bonded part 1416. Further, the base 120 and the second sheet element 122 are welded together toward the ends in the transverse direction X to form a 17th bonded part 1417. The brush part 110 is bonded to the base 120, for example, by an adhesive to form an 18th bonded part 1418. In this manner, the cleaning element 108 is formed.

In the cleaning element 108 of the eighth modification, the extending region 110L is formed on the end 120B sides of the base 120 in the longitudinal direction Y, so that the same effect as the cleaning element 100 of the above-described embodiment can be obtained in a cleaning work in which the cleaning element 108 is moved in the longitudinal direction Y.

(Ninth Modification)

Figure 18:
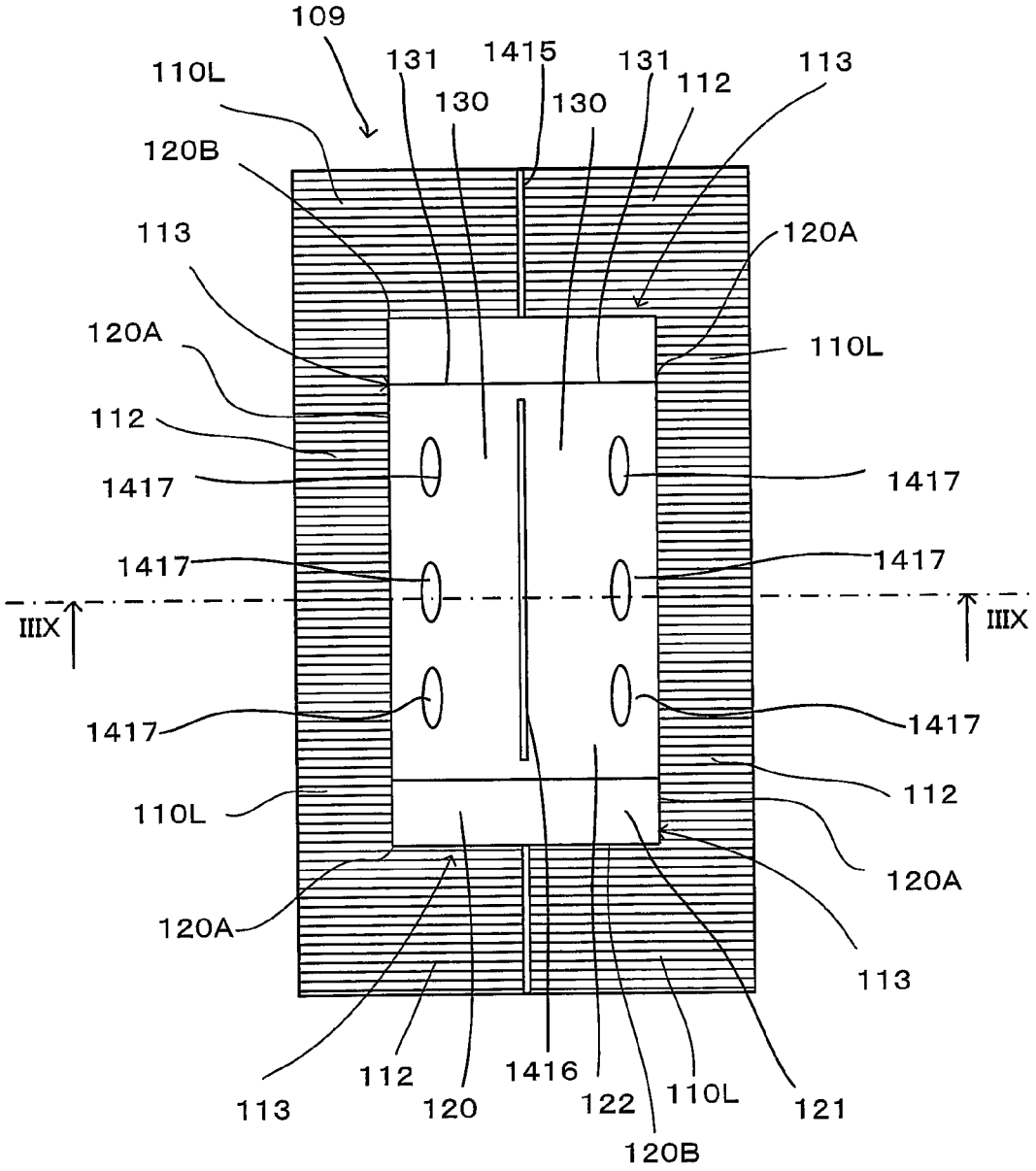
FIG. 18 is an explanatory drawing of a cleaning element according to a ninth modification of the present invention.
Figure 19:
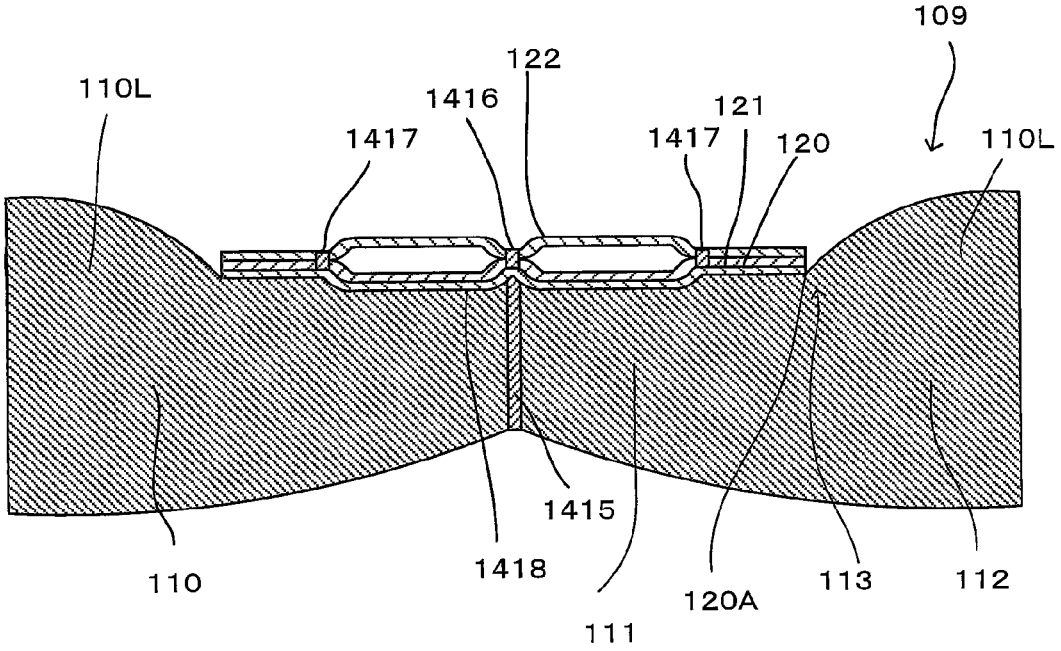
FIG. 19 is a sectional view taken along line IIIX-IIIX in FIG. 18.

A ninth modification is explained with reference to FIGS. 18 and 19. A cleaning element 109 of the ninth modification is different from the cleaning element 100 of the above-described embodiment in that the extending region 110L is formed both on the end 120A sides of the base 120 in the transverse direction X and on the end 120B sides of the base 120 in the longitudinal direction Y.

Specifically, the brush part 110 is longer than the base 120 in both the transverse direction X and the longitudinal direction Y.

Each component of the cleaning element 109 of the ninth modification is bonded in the same manner as in the cleaning element 108 of the eighth modification, which is not therefore described.

In the cleaning element 109 of the ninth modification, the extending region 110L is formed on the end 120A sides of the base 120 in the transverse direction X and on the end 120B sides of the base 120 in the longitudinal direction Y, so that the same effect as the cleaning element 100 of the above-described embodiment and the same effect as the cleaning element 108 of the eighth modification can be obtained at the same time.

(Correspondences Between the Features of the Embodiment and the Features of the Invention)

The cleaning tool A is an example embodiment that corresponds to the "cleaning tool" according to this invention. The cleaning element 100, 101, 102, 103, 104, 105, 106, 107, 108, 109 is an example embodiment that corresponds to the "cleaning sheet" according to this invention. The cleaning element holder 200 is an example embodiment that corresponds to the "holder" according to this invention. The longitudinal direction Y and the transverse direction X are example embodiments that correspond to the "longitudinal direction" and the "transverse direction", respectively, according to this invention. The cleaning element holding part 220 is an example embodiment that corresponds to the "holding part" according to this invention. The handle part 210 is an example embodiment that corresponds to the "grip part" according to this invention. The brush part 110 is an example embodiment that corresponds to the "brush part" according to this invention. The base 120 is an example embodiment that corresponds to the "base" according to this invention. The holding space 130 is an example embodiment that corresponds to the "insertion part" according to this invention. The bending region 113 is an example embodiment that corresponds to the "bending region" according to this invention. The first cleaning region 111 is an example embodiment that corresponds to the "first cleaning region" according to this invention. The second cleaning region 112 is an example embodiment that corresponds to the "second cleaning region" according to this invention. The extending region 110L is an example embodiment that corresponds to the "extending region" according to this invention. The fiber assembly 110GF is an example embodiment that corresponds to the "fiber assembly" according to this invention. The first sheet element 121, the second sheet element 122, the third sheet element 123, the fourth sheet element 124, the fifth sheet element 125 and the sixth sheet element 126 are example embodiments that correspond to the "first sheet element", the "second sheet element", the "third sheet element", the "fourth sheet element", the "fifth sheet element" and the "sixth sheet element", respectively, according to this invention. The one side 120C and the other side 120D are example embodiments that correspond to the "one side" and "the other side", respectively, according to this invention.

Embodiments and modifications of the present invention are not limited to those described above. The structures or features of the above-described embodiment and modifications can be appropriately used in combination, and can be added to, changed, replaced with alternatives or otherwise modified.

In view of the nature of the above-described invention, a cleaning tool according to this invention can be provided with various features as follows.

(Aspect 1)

A cleaning tool, having a cleaning sheet and a holder for holding the cleaning sheet, wherein:

the cleaning sheet is configured to extend in a longitudinal direction which is defined by a direction of insertion of the holder into the cleaning sheet, and in a transverse direction which is defined by a direction crossing the longitudinal direction, the holder has a holding part for holding the cleaning sheet, and a grip part which is connected to the holding part and designed to be held by a user, the cleaning sheet has a brush part capable of cleaning an object to be cleaned, a base connected with the brush part, and an insertion part which is formed on the base and into which the holding part is inserted, and the brush part is configured to have a first cleaning region, a second cleaning region and a bending region between the first and second cleaning regions by being bent at an end of the base.

(Aspect 2)

The cleaning tool as defined in aspect 1, wherein the brush part is configured to be longer than the base and has an extending region.

(Aspect 3)

The cleaning tool as defined in aspect 1 or 2, wherein the first cleaning region is formed in a region of the brush part which is overlapped on the base.

(Aspect 4)

The cleaning tool as defined in any one of aspects 1 to 3, wherein the second cleaning region is formed in a region of the brush part which is not overlapped on the base.

(Aspect 5)

The cleaning tool as defined in any one of aspects 1 to 4, wherein the second cleaning region is provided in the transverse direction.

(Aspect 6)

The cleaning tool as defined in any one of aspects 1 to 4, wherein the second cleaning region is provided in the longitudinal direction.

(Aspect 7)

The cleaning tool as defined in any one of aspects 1 to 4, wherein the second cleaning region is provided in the longitudinal direction and the transverse direction.

(Aspect 8)

The cleaning tool as defined in any one of aspects 1 to 7, wherein the brush part comprises a fiber assembly.

(Aspect 9)

The cleaning tool as defined in any one of aspects 1 to 8, wherein the base comprises a first sheet element.

(Aspect 10)

The cleaning tool as defined in aspect 9, comprising a second sheet element which is superposed on the first sheet element, wherein the insertion part is formed between the first sheet element and the second sheet element.

(Aspect 11)

The cleaning tool as defined in aspect 9, wherein the insertion part is formed by forming a bonding sheet region by contact of prescribed surfaces of the first sheet element with each other and bonding the prescribed surfaces in the bonding sheet region.

(Aspect 12)

The cleaning tool as defined in aspect 9, comprising a third sheet element which is superposed on the first sheet element, and a fourth sheet element which is superposed on the third sheet element, wherein the insertion part is formed between the third sheet element and the fourth sheet element.

(Aspect 13)

The cleaning tool as defined in aspect 9, comprising a fifth sheet element which is superposed on the first sheet element, wherein the insertion part is formed by forming a bonding sheet region by contact of prescribed surfaces of the fifth sheet element with each other and bonding the prescribed surfaces in the bonding sheet region.

(Aspect 14)

The cleaning tool as defined in any one of aspects 1 to 13, wherein the brush part is provided on one side of the base.

(Aspect 15)

The cleaning tool as defined in any one of aspects 1 to 13, wherein the brush part is provided on one side and the other side of the base.

(Aspect 16)

The cleaning tool as defined in any one of aspects 1 to 15, wherein the second cleaning region is formed in the extending region.

(Aspect 17)

The cleaning tool as defined in any one of aspects 1 to 16, wherein the first cleaning region, the second cleaning region and the bending region have a first cleaning surface, a second cleaning surface and a bending cleaning surface, respectively, all of which can come in contact with the object to be cleaned.

(Aspect 18)

The cleaning tool as defined in any one of aspects 1 to 17, wherein an extending direction of the first cleaning surface coincides with an extending direction of the second cleaning surface.

The invention claimed is:

1. A cleaning tool, comprising:

a cleaning sheet; and a holder configured to hold the cleaning sheet, wherein:

the cleaning sheet extends in a longitudinal direction which is defined by a direction of insertion of the holder into the cleaning sheet, and in a transverse direction crossing the longitudinal direction, the holder has a holding part configured to hold the cleaning sheet, and a grip part connected to the holding part and configured to be held by a user, the cleaning sheet has a brush part configured to clean an object to be cleaned, a base connected with the brush part, and an insertion part which is formed on the base and into which the holding part is to be inserted, the base has opposite ends in the transverse direction, the brush part has a first cleaning region, a second cleaning region, and a bending region between the first and second cleaning regions and configured to be bent at one of the ends of the base when in use, the base and the brush part are bonded at (i) a central bonded part and (ii) first bonded parts between the central bonded part and the ends of the base in the transverse direction, and the first bonded parts extend through the base and extend into the first cleaning region of the brush part.

2. The cleaning tool as defined in claim 1, wherein the brush part is longer than the base in the transverse direction and has an extending region extending beyond the base in the transverse direction.

3. The cleaning tool as defined in claim 1, wherein the first cleaning region overlaps the base in a thickness direction perpendicular to the longitudinal and transverse directions.

4. The cleaning tool as defined in claim 3, wherein the second cleaning region does not overlap the base in the thickness direction.

5. The cleaning tool as defined in claim 1, wherein the second cleaning region extends in the transverse direction.

6. The cleaning tool as defined in claim 1, wherein the second cleaning region extends in the longitudinal direction.

7. The cleaning tool as defined in claim 1, wherein the second cleaning region extends in the longitudinal direction and the transverse direction.

8. The cleaning tool as defined in claim 1, wherein the brush part comprises a fiber assembly.

9. The cleaning tool as defined in claim 1, wherein the base comprises a first sheet element.

10. The cleaning tool as defined in claim 9, further comprising a second sheet element superposed on the first sheet element, wherein the insertion part is formed between the first sheet element and the second sheet element.

11. The cleaning tool as defined in claim 1, wherein the brush part is provided on one side of the base.

12. The cleaning tool as defined in claim 1, wherein the brush part is provided on one side and another side of the base opposite to the one side in a thickness direction perpendicular to the longitudinal and transverse directions.

13. A cleaning tool, comprising:

a cleaning sheet; and a holder configured to hold the cleaning sheet, wherein the cleaning sheet extends in a longitudinal direction defined by a direction of insertion of the holder into the cleaning sheet, and in a transverse direction crossing the longitudinal direction, the holder has a holding part configured to hold the cleaning sheet, and a grip part connected to the holding part and configured to be held by a user, the cleaning sheet has a brush part configured to clean an object to be cleaned, and a sheet element connected with the brush part, the brush part has a first cleaning region, a second cleaning region, and a bending region between the first and second cleaning regions, and the sheet element is folded and bonded onto itself at a bonding sheet region to form an insertion part into which the holding part is to be inserted.

14. The cleaning tool as defined in claim 13, wherein the cleaning sheet further includes a further sheet element sandwiched between said sheet member and the brush part in a thickness direction perpendicular to the longitudinal and transverse directions, the further sheet element has opposite ends in the transverse direction, and the bending region is configured to be bent at one of the ends of the further sheet element when in use.

15. The cleaning tool as defined in claim 13, wherein the sheet element is a single sheet directly bonded to the brush part, the sheet element has opposite ends in the transverse direction, and the bending region is configured to be bent at one of the ends of the sheet element when in use.

16. A cleaning tool, comprising:

a cleaning sheet; and a holder configured to hold the cleaning sheet, wherein the cleaning sheet extends in a longitudinal direction defined by a direction of insertion of the holder into the cleaning sheet, and in a transverse direction crossing the longitudinal direction, the holder has a holding part configured to hold the cleaning sheet, and a grip part connected to the holding part and configured to be held by a user, the cleaning sheet has a brush part configured to clean an object to be cleaned, a base having a first sheet member and connected with the brush part, a pair of sheet members superposed on the first sheet member, and an insertion part which is on the base and into which the holding part is to be inserted, the brush part has a first cleaning region, a second cleaning region, and a bending region between the first and second cleaning regions and configured to be bent at an end of the base when in use, one of the pair of sheet members is superposed on the other sheet member, and the insertion part is formed between the pair of sheet members.

* * * * *